US006591902B1

(12) United States Patent
Trent

(10) Patent No.: US 6,591,902 B1
(45) Date of Patent: Jul. 15, 2003

(54) APPARATUS FOR APPLYING CONTROLLABLE, MULTIPURPOSE HEAT PIPES TO HEATING, VENTILATION, AND AIR CONDITIONING SYSTEMS

(76) Inventor: Richard W. Trent, 2108 Lobolly La., Johns Island, SC (US) 29455

( * ) Notice: Subject to any disclaimer, the term of this patent is extended or adjusted under 35 U.S.C. 154(b) by 0 days.

(21) Appl. No.: 09/695,201

(22) Filed: Oct. 24, 2000

Related U.S. Application Data

(63) Continuation-in-part of application No. 09/440,232, filed on Nov. 15, 1999, now abandoned, which is a continuation-in-part of application No. 09/222,139, filed on Dec. 29, 1998, now abandoned.

(51) Int. Cl.[7] ..... F28D 15/02; F25B 5/04

(52) U.S. Cl. ..... 165/274; 165/272; 165/104.14; 165/104.21; 62/90; 62/95

(58) Field of Search ..... 165/104.14, 104.21, 165/274, 272; 62/90, 95

(56) References Cited

U.S. PATENT DOCUMENTS 3,603,379 A * 9/1971 Leonard, Jr. ..... 165/104.21
4,607,498 A * 8/1986 Dinh ..... 165/104.21
4,921,041 A * 5/1990 Akachi ..... 165/104.14
5,219,020 A * 6/1993 Akachi ..... 165/104.14
5,333,470 A * 8/1994 Dinh ..... 165/104.14
5,404,938 A * 4/1995 Dinh ..... 165/104.14
5,921,315 A * 7/1999 Dinh ..... 165/104.14

FOREIGN PATENT DOCUMENTS

GB 600231 * 4/1948 ..... 165/104.14

* cited by examiner

*Primary Examiner*—John K. Ford
(74) *Attorney, Agent, or Firm*—Edward P. Dvtkiewicz

(57) ABSTRACT

An air conditioning system has a plurality of heat pipes including an input coil at the input end of a chiller for the passage of input air there through and an output coil at the output end of a chiller for the passage of output air there through. Each of the heat pipes has a vapor leg and a liquid leg coupling the vapor coil and liquid coil for the flow of a working fluid there through. At least one back flow abater is in the liquid leg for controlling the back flow of the working fluid within the liquid leg.

1 Claim, 4 Drawing Sheets

FIG. 1
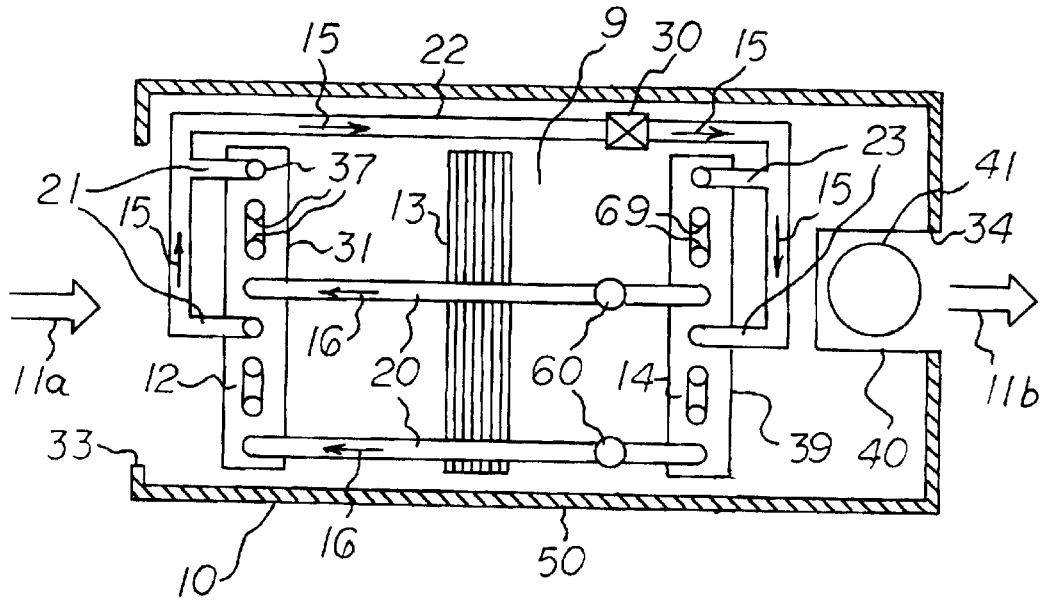
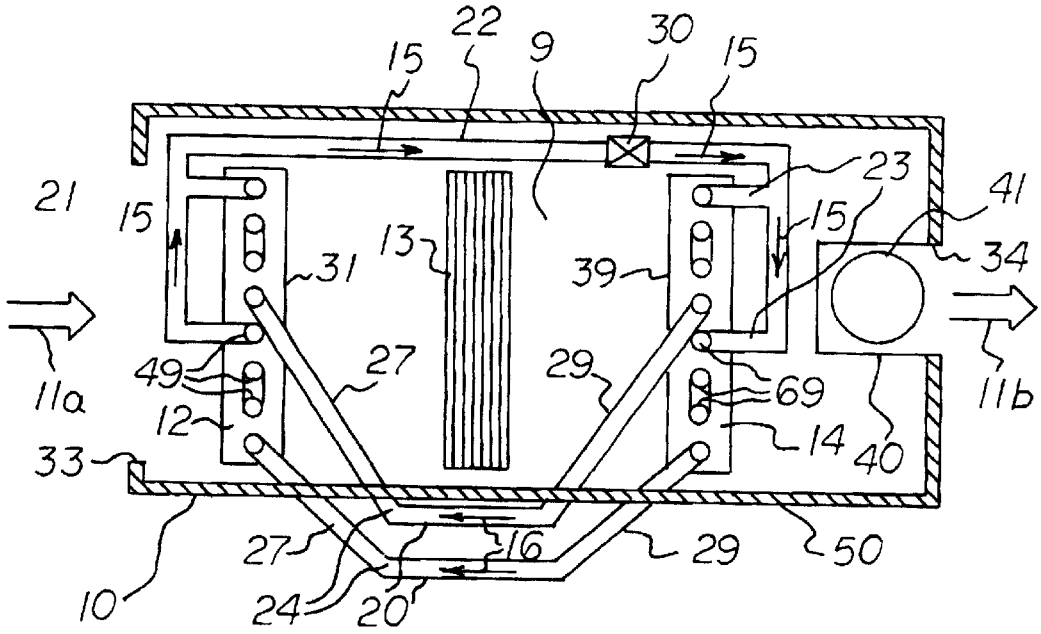
FIG 2

FIG 3
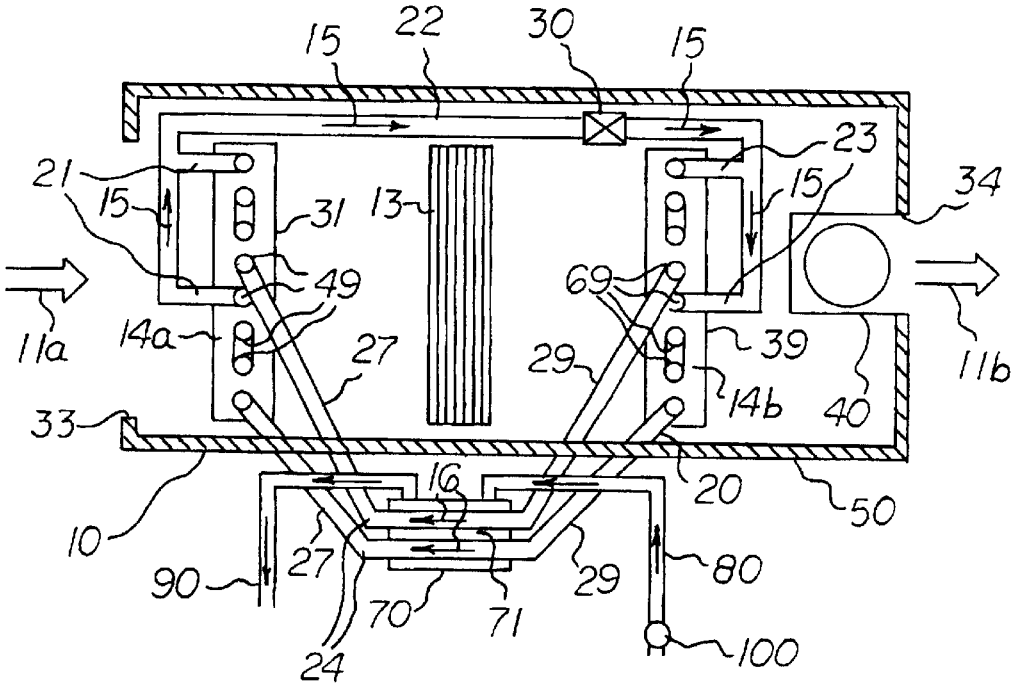
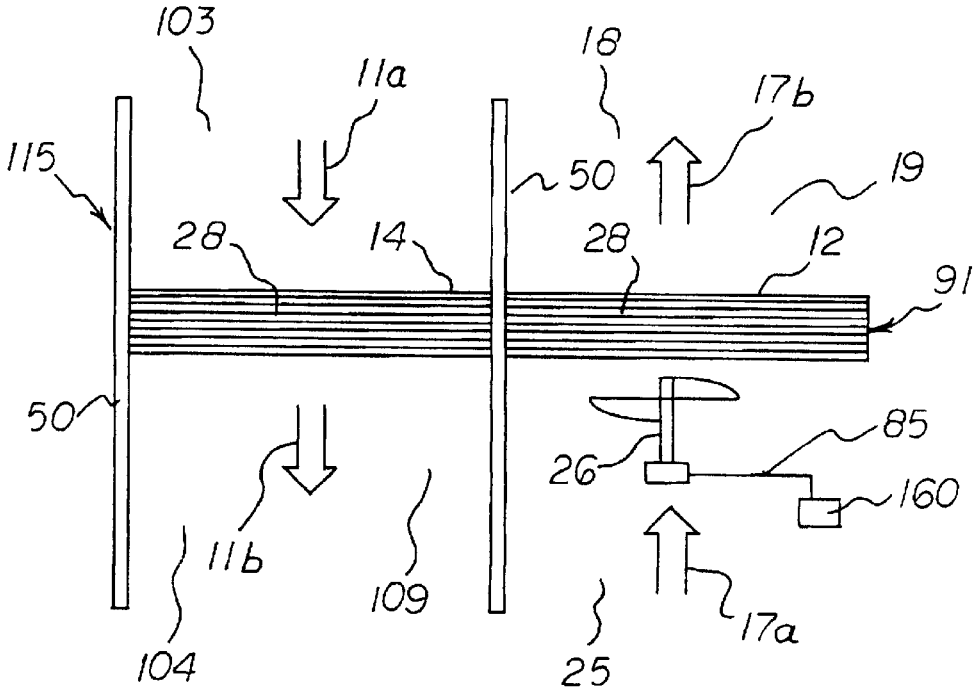
FIG 4

FIG 3A
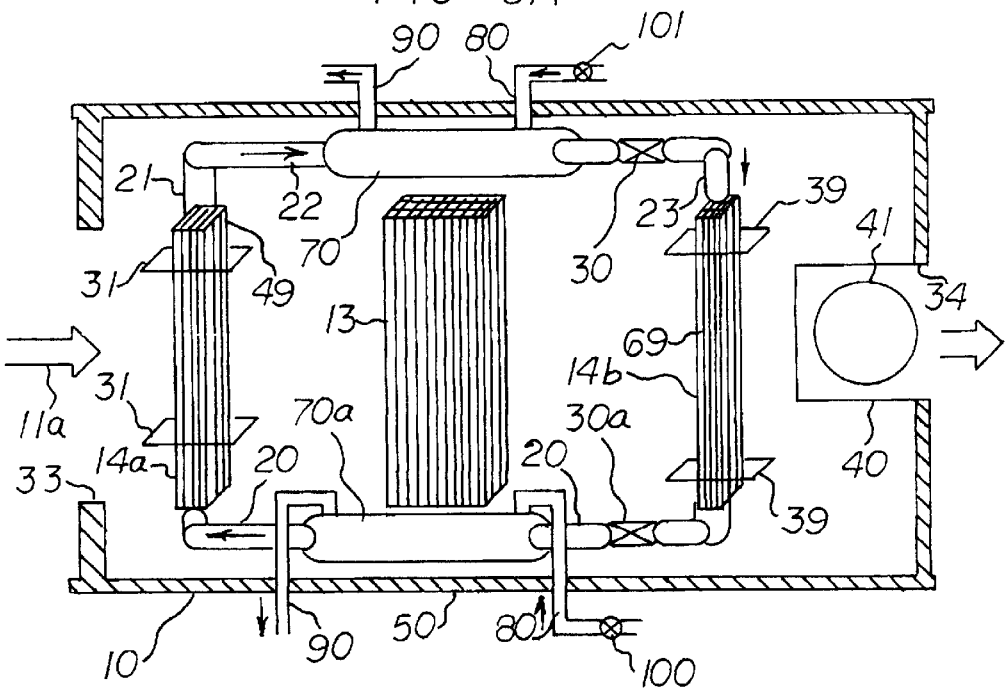
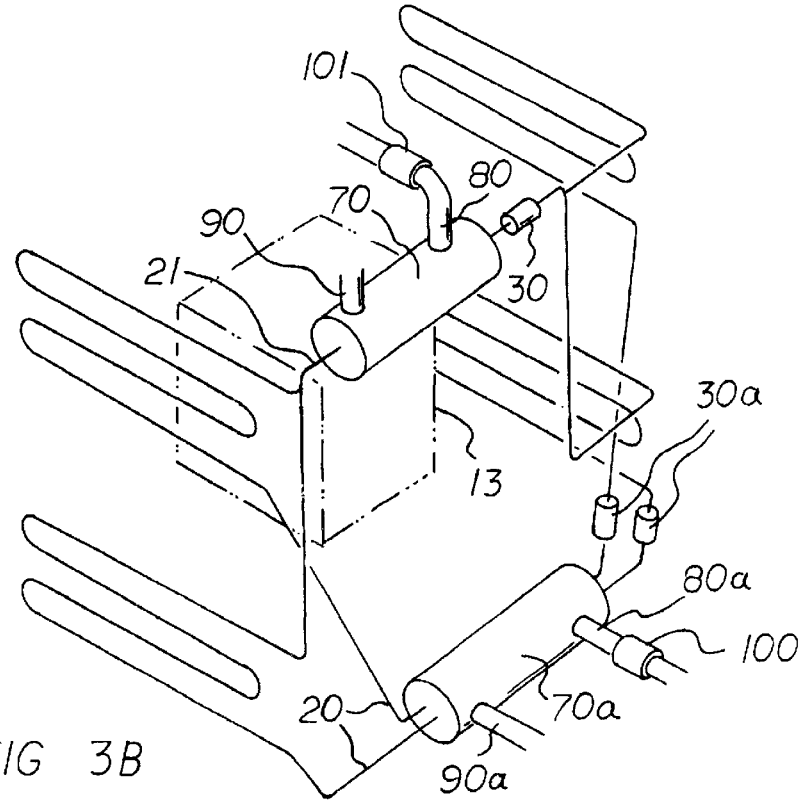
FIG 3B

FIG 5
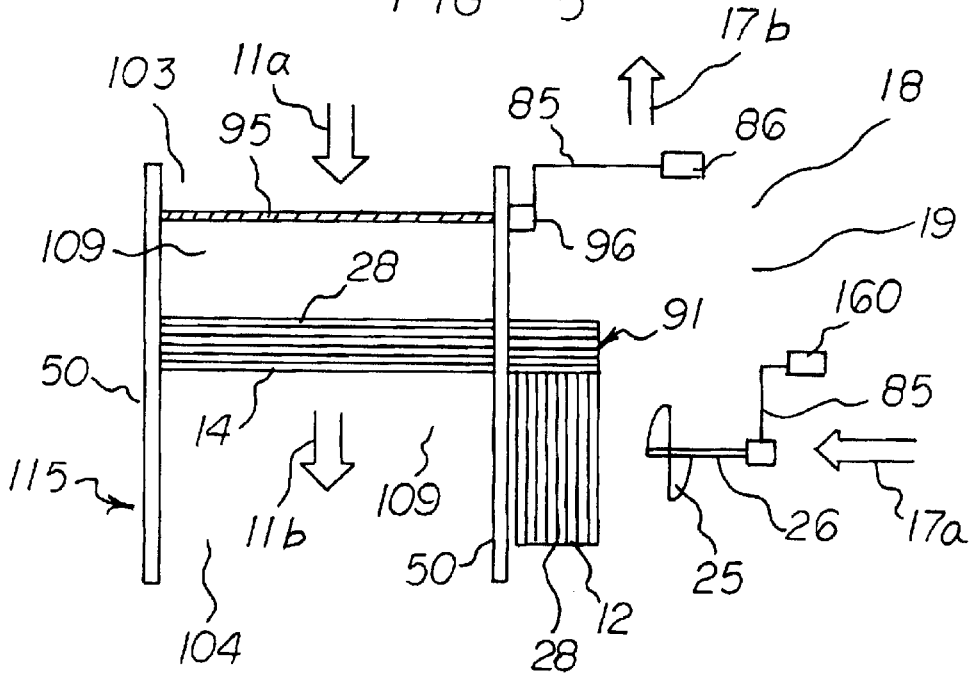
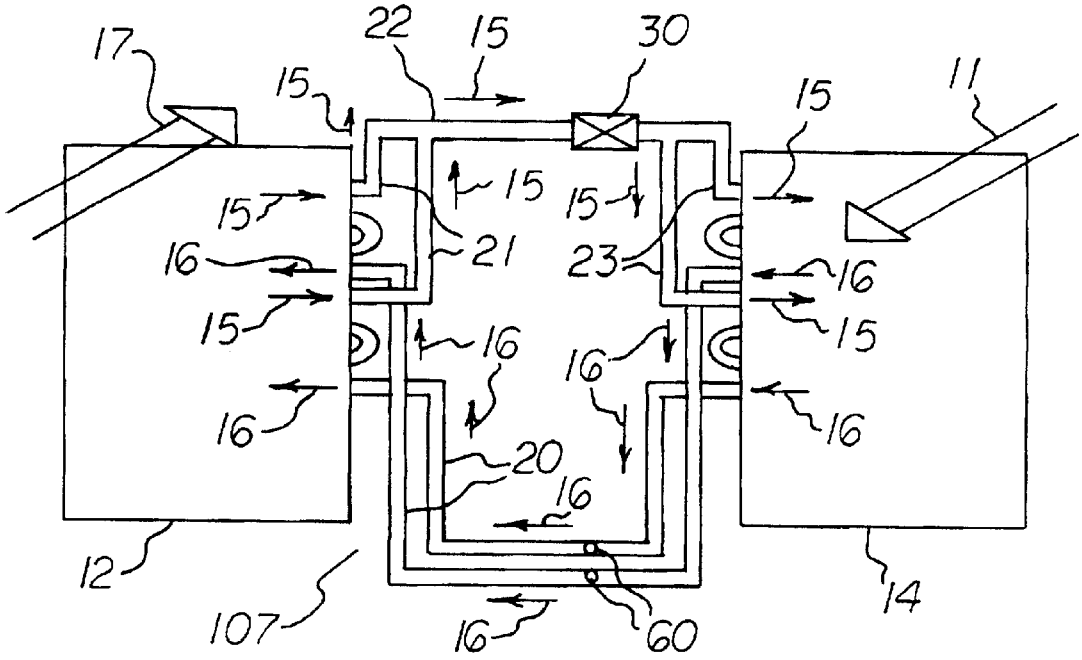
FIG 6

APPARATUS FOR APPLYING CONTROLLABLE, MULTIPURPOSE HEAT PIPES TO HEATING, VENTILATION, AND AIR CONDITIONING SYSTEMS

RELATED U.S. PATENT APPLICATIONS

This application is a Continuation-in-Part of U.S. application Ser. No. 09/440,232 filed Nov. 15, 1999 entitled "Application of Heat Pipe Science to Heating, Refrigeration, and Air Conditioning Systems", now abandoned, which is a Continuation-in-Part of U.S. application Ser. No. 09/222,139 filed Dec. 29, 1998, now abandoned, the subject matter of which applications is herein incorporated herein by reference.

FIELD OF INVENTION

The present invention is generally directed to an apparatus and method for use in heating, ventilation, and/or air conditioning systems ("HVAC systems"). More particularly, the present invention is directed to an apparatus and method employing a controllable, multipurpose heat pipe system that provides an improved, more energy efficient HVAC system. Advantages of the present invention are especially apparent when the present invention is applied to buildings utilizing centralized HVAC systems.

BACKGROUND OF THE INVENTION

HVAC systems generally function to heat or cool air to a more comfortable temperature by manipulating the transfer of heat. For example, an air conditioning system may contain a cooling coil that absorbs heat from hot air to lower the air's temperature. Similarly, a heating system may utilize a heated gas or liquid to transfer heat to cold air to increase the air's temperature.

Heat transfer from or to air may be effected within such HVAC systems by the use of a working fluid or refrigerant, such as ammonia, R134a (tetrafluoroethane), or similar fluids. These working fluids are generally capable of changing state under various conditions of temperature and pressure. With each change of state, the working fluid either accepts energy or gives up energy. As a result, this energy is either removed or added to the air, respectively, so that cold air may be heated or hot air may be cooled.

In a conventional air conditioning system, the working fluid generally moves in the following cycle of operation: (1) from a compressor; (2) to a condenser; (3) through an expansion valve; (4) to an evaporator; and then (5) back to the compressor. In one such air conditioning system, the working fluid enters the compressor as a low temperature gas at about 65 F. and leaves the compressor as a high temperature gas at about 150 F. The working fluid then enters the condenser. Within the condenser, the working fluid thermally communicates with, and gives up heat to, surrounding cooler air, and the working fluid is converted from a high temperature gas into a cooler liquid of about 90 degrees F. The working fluid then passes through an expansion valve to a region of low pressure. As a result, the working fluid begins to change state from a liquid to a low temperature gas of about 45 degrees F. The working fluid then moves to the evaporator, where the working fluid thermally communicates with, and absorbs heat from, hot air surrounding the evaporator. As heat is transferred from the hot air to the working fluid, the hot air is cooled, and the working fluid is heated to become a gas of about 65 degrees F.

In general, an air conditioning system may provide sensible cooling and latent cooling. Sensible cooling is associated with reducing the temperature of air, while latent cooling is associated with decreasing the moisture content of air (dehumidification). For example, when air is cooled, but is not cooled below its dewpoint, only sensible cooling has occurred. On the other hand, when air is cooled to its dewpoint (approximately 60 degrees F.), moisture in the air begins to condense, and dehumidification (latent cooling) of the air begins. If the air is cooled below its dewpoint, further dehumidification occurs. Therefore, when air is cooled below its dewpoint, both sensible and latent cooling have occurred, because the air's temperature has been reduced (sensible cooling), and moisture has been removed from the air (latent cooling). In order for conditioned air to be comfortable to humans, the air must be at a comfortable temperature, and it must contain an appropriate level of moisture.

In some air conditioning systems, air is reheated after being cooled and dehumidified. In one such air conditioning system, warm air enters at approximately 80 F. The air then moves through the system's evaporator and is typically cooled to approximately 55 degrees F. or lower. During this cooling process, when the air temperature reaches its dewpoint (approximately 60 degrees F.), moisture in the air condenses (dehumidification begins). As the temperature of the air falls below the dewpoint, additional moisture is removed from the air. Such cooling normally produces air that is colder than desired for human comfort. However, this degree of cooling is often required to provide the necessary amount of dehumidification. In essence, the air conditioning system's evaporator generally overcools the air in order to remove an appropriate amount of moisture. Accordingly, some air conditioning systems reheat the dehumidified air to a more comfortable level. Such systems are very energy inefficient, because excess energy is used in the overcooling (dehumidification) and reheating processes.

Heat pipes are passive devices that may be used to heat or cool air by manipulating the transfer of heat from a heat source to a heat sink, or vice versa. Heat pipes may contain a precise amount of working fluid or refrigerant, such as ammonia. The working fluid is generally contained within the heat pipe and may be cycled continuously through at least two elements: an evaporator and a condenser. Adiabatic section(s) may be included in the heat pipe to allow the working fluid to pass between the evaporator and the condenser without transferring heat to or from the surroundings.

Evaporators and condensers are generally configured to allow heat exchange with the environments that surround them. For example, a heat pipe evaporator may be configured to absorb heat from a heat source, such as hot, unconditioned air that passes around the evaporator. Similarly, a heat pipe condenser may be configured to release heat into a heat sink, such as cool, conditioned air that passes around the condenser. As such, a heat pipe may act as either a heater or a cooler depending on its orientation.

In general the heat pipe's working fluid enters a heat pipe's evaporator in a liquid state. The working fluid in the evaporator absorbs heat from a heat source, such as hot, unconditioned air. As a result, the hot air may be cooled, and the working fluid is transformed from a liquid to a vapor. The vaporized fluid then passes from the evaporator, through an adiabatic section (in some embodiments), into a condenser. In the condenser, the vapor releases heat to a heat sink, such as cool, conditioned air. As a result, the cool air may be heated, and the working fluid is transformed from a vapor to a liquid within the condenser. The condensed working fluid is then returned to the evaporator, in a liquid state, by the force of gravity and/or capillary forces through a wick. The return path may be through an adiabatic section or other connecting section.

To improve conditioning performance, some air conditioning systems utilize heat pipe heat exchangers. In these systems, heat pipe technology is used to increase moisture removal capacity and/or to provide passive reheat capability. Such systems are disclosed in U.S. Pat. No. 2,093,725 to Hull; U.S. Pat. No. 4,607,498 to Dinh; U.S. Pat. No. 4,971,139 to Khattar and U.S. Pat. No. 5,695,004 to Beckwith.

Generally, conventional dehumidification heat pipe systems have been used in the following manner. Hot air enters the HVAC system. The heat pipe may be used to precool the hot air before the hot air is cooled by the air conditioning system. In such a system, a heat pipe may be disposed around the air conditioning system's main cooling coil (or main evaporator). Generally, the heat pipe's evaporator will be positioned upstream of the main cooling coil, while the heat pipe's condenser is positioned downstream of the main cooling coil. As such, the hot air passes over the heat pipe's evaporator and heat may be absorbed from unconditioned hot air by the heat pipe's evaporator. This precool the air. Then the precooled air passes over the system's main cooling coil and is cooled further and becomes dehumidified. The heat may then be transferred via the heat pipe's condenser to cool the dehumidified air that leaves the cooling coil. As a result, the main air conditioning system may cool the precooled air to a lower temperature than would otherwise be possible. As described above, by cooling the air to a lower temperature, more moisture may be removed from the air. The cool, dehumidified air passes over the heat pipe's condenser and is partially reheated to reheat the air that exits the HVAC system. Because heat is absorbed from the unconditioned hot air (by the heat pipe's evaporator) and then transferred to the dehumidified cooled air (by the heat pipe's condenser), the dehumidified cooled air may be reheated before it exits the cooling system. As described above, by reheating the air after it has been dehumidified, the air will be more comfortable to humans.

A significant problem with conventional heat pipe systems relates to their use during the cooling season. Generally, moisture must be removed from hot, unconditioned air during the cooling season in order to make the air comfortable to humans. As described above, in order to remove this moisture, the hot air must be cooled to temperatures below its dewpoint (approximately 60 F.). During regular operation, the hot air will be excessively cooled to remove an appropriate amount of moisture. Then the cooled air will be reheated before it exits the cooling system. However, at certain peak load times during the day, one may want to maximize the sensible heat removing capacity of the cooling system by cooling the air to its lowest possible temperature. In such a case, it would be inefficient and counterproductive to reheat the air before it exits the cooling system. Thus, when heat pipe heat exchangers are used in conjunction with an air conditioning system to precool and reheat conditioned air, it may be desirable to control the heat transfer characteristics of the heat pipe exchanger. For example, on days having significant peak loads, it may be desirable to modify or eliminate the heat pipe's function of reheating cooled air.

Another problem with conventional heat pipe systems relates to their presence in HVAC systems during the heating season. Heat pipe systems generally perform no beneficial function during the heating season, because cold, unconditioned air generally does not require dehumidification. As such, a heat pipe system imposes an unnecessary resistance to the flow of air through the HVAC system during the heating season. As a result, a fan motor of greater horsepower is needed to maintain proper air flow through the system, and the overall energy efficiency of the HVAC system is reduced due to the increased energy consumption of such a fan. Therefore, the energy efficiency of such a system will vary in proportion to the length of the heating season. When the heating season is longer, the annual energy efficiency of the system will be less.

Accordingly, a need exists for a controllable HVAC system that includes a heat pipe that is functional and energy efficient in various environments. In particular, there is a need for a controllable, multipurpose heat pipe system that can operate efficiently during both the cooling and heating seasons.

A further problem with conventional heat pipe systems relates to their use with central HVAC systems that operate in buildings comprised of different heating or cooling zones. In such buildings, the heating or cooling load of each zone may vary at any given time. In the past, heat pipe systems have been disposed around a central cooling coil to provide a means for controlling the temperature and moisture content of air at the central unit. However, these systems did not provide a means for controlling the temperature or humidity within the individual zones.

As such, a need exists for a heat pipe system that can be applied to a central HVAC system for conditioning individual zones. In particular, a need exists for a heat pipe system that can help efficiently control the temperature and humidity of air within the individual zones.

OBJECTS AND SUMMARY OF THE INVENTION

The present invention recognizes and addresses the foregoing disadvantages, and others, of prior art constructions and methods. Accordingly, a primary object of the present invention is to provide a controllable, multipurpose apparatus for controlling air temperature in HVAC systems.

Another object of the present invention is to efficiently manage the latent cooling capacity and sensible cooling capacity of an air conditioning system during various loads by providing mechanisms for controlling the flow of a secondary working fluid within the apparatus.

A further object of the present invention is to improve the design of heat pipe heat exchangers that are used within HVAC systems. A more particular object of the present invention is to provide a heat pipe system that performs typical dehumidification functions during the cooling season and that provides useful functions during the heating season as well.

An additional object of the present invention is to provide a heat pipe system that improves the efficiency of heat transfer within a heating system.

Another object of the present invention is to improve the overall energy efficiency of an HVAC system by providing an apparatus that minimizes airflow resistance within the system.

Still another object of the present invention is to provide an apparatus for controlling the air temperature of individual zones within a building that is conditioned by a centrally located HVAC system.

Some of these objects, and others, are achieved by providing a passive, energy efficient apparatus that is suitable for controlling air temperature in an air passage of an HVAC system. The apparatus employs a secondary heat transfer unit that preferably includes at least one heat pipe. A secondary fluid contained within the heat pipe functions as the working fluid within the heat pipe.

In a presently preferred embodiment of the present invention, the heat pipe further includes at least two conducting sections. In some embodiments, the first conducting section that thermally communicates with the air that is to be conditioned is an evaporator, and the second conducting section is a condenser. In other embodiments, the heat pipe may contain a third conducting section that also functions as a condenser.

In one embodiment of the present invention, a heat pipe evaporator is positioned upstream from an air conditioning system's main cooling coil. As such, warm air entering the system thermally communicates with the heat pipe evaporator before the air thermally communicates with the main cooling coil. The heat pipe evaporator absorbs heat from the warm air, and, as a result, the warm air is precooled before it reaches the system's main cooling coil. The heat absorbed by the heat pipe evaporator is transferred to the working fluid within the evaporator. Consequently, the working fluid exiting the heat pipe's evaporator is vaporized. The vaporized fluid flows from the heat pipe's evaporator into the heat pipe's condenser via an interconnecting vapor line, which, in some embodiments, may comprise an adiabatic section.

In some embodiments of the present invention, the heat pipe condenser thermally communicates with a heat sink, such as a cold air mass. For example, the heat pipe's condenser may be positioned downstream from the cooling system's main cooling coil, so that the heat pipe's condenser thermally communicates with cool air leaving the main cooling coil. Alternatively, the heat pipe's condenser may be positioned within a duct containing cool return air from a cool zone. In further embodiments, the heat pipe's condenser may be positioned in a cool zone within the building.

When vaporized working fluid passes through the heat pipe's condenser, heat is removed from the working fluid and is absorbed by the cold air mass (heat sink). As a result, the working fluid is condensed back to its liquid state, and the cold air mass is warmed. The condensed working fluid that leaves the heat pipe's condenser flows in liquid form, back to the heat pipe's evaporator via at least one interconnecting liquid line, which, in some embodiments, may comprise an adiabatic section.

In a presently preferred embodiment of the present invention, one or more mechanisms may be provided within the heat pipe to precisely control the amount of heat transferred by the heat pipe. The mechanism(s) may interrupt or modulate the flow of the working fluid between the components of the heat pipe. For example, flow control valves may be installed between the evaporator and the condenser to interrupt or reduce the flow of working fluid from the evaporator to the condenser, or vice versa. Such valves can thereby prevent or reduce heat transfer by the heat pipe from the heat source (hot air) to the heat sink (cold air). The control valves may be manually operated, may be controlled by an automatic operating device such as a thermostat or humidistat, or may be remotely controlled.

In a further embodiment, flow control valves may be installed between the heat pipe's condenser and the heat pipe's evaporator to ensure that the interconnecting liquid line(s) do not allow the condensed working fluid to flow from the evaporator back to the condenser. Similarly, in another embodiment, the interconnecting liquid lines may be geometrically configured so that the condensed working fluid is prevented from flowing back to the condenser from the evaporator. Additionally, the interconnecting liquid lines may be configured to prevent vaporized working fluid from flowing out of the condenser to the evaporator until the vaporized fluid is condensed. Further, the interconnecting liquid lines may be configured to prevent vaporized working fluid from flowing out of the evaporator to the condenser through the interconnecting liquid lines. The above indicated mechanisms and configurations function to ensure that vaporized fluid flows from the evaporator to the condenser via the interconnecting vapor line(s), and that condensed fluid flows from the condenser to the evaporator via the interconnecting liquid line(s). When such a flow is maintained, the heat transfer process caused by the heat pipe will be continuous, as long as there is a temperature difference between the heat source (warm air surrounding the heat pipe's evaporator) and the heat sink (cold air surrounding the heat pipe's condenser).

Other objects of the present invention are achieved by an HVAC system that utilizes at least one secondary heat transfer unit. In some embodiments, the secondary heat transfer unit is a heat pipe heat exchanger that contains a secondary working fluid. In such an embodiment, the heat pipe contains at least a first section that functions as an evaporator and at least a second section that functions as a condenser. In a further embodiment, the heat pipe may contain at least a third section that also functions as a condenser.

Such an HVAC system further comprises a heat exchanger "vessel" that provides a heat source, such as a heated gas or liquid. The vessel may be configured to allow thermal communication between the heat source (contained within the vessel) and the secondary working fluid (contained within the heat pipe). In such a system, the vessel provides heat to the heat pipe's evaporator. As a result, the working fluid within the evaporator is transformed from a liquid to a vapor. The vaporized working fluid then flows into at least one of the heat pipe's condensers, where the vaporized fluid thermally communicates with cool air within the HVAC system. The cool air absorbs heat from the vaporized fluid. As such, the cool air is warmed, and the working fluid is condensed. The condensed working fluid flows from the heat pipe's condenser(s) into the heat pipe's evaporator, and the heat transfer process continues as long as there is a temperature difference between the heat source (contained within the vessel) and the cool air (within the HVAC system).

Further objects of the present invention are accomplished by an HVAC system that utilizes at least one secondary heat transfer unit. The secondary heat transfer unit has at least a first heat conducting section and a second heat conducting section. The second heat conducting section is at least partially disposed outside the supply duct of the HVAC system.

Preferably, the secondary heat transfer unit employs at least one heat pipe heat exchanger. Further, the heat pipe preferably contains at least one evaporator (a first conducting section) and at least one condenser (a second conducting section). In one such embodiment, the evaporator section is disposed outside the supply duct of the HVAC system, while the condenser section is disposed within the supply duct. Such a configuration provides less resistance to air flowing within the supply duct and allows the evaporator to thermally communicate with air in an outer air passage outside the supply duct.

The heat pipe further contains a secondary working fluid, which is composed of any fluid that readily transfers heat with the environment at the desired temperature conditions. Refrigerants such as freon provide a suitable working fluid. In a heating system embodiment, the working fluid within the heat pipe evaporator thermally communicates with warm air outside the supply duct, so that heat is absorbed by the working fluid. As a result, the working fluid vaporizes within the evaporator. The vaporized working fluid then flows to the heat pipe's condenser located within the supply duct. Within the condenser, the vaporized fluid releases heat to cool air that is flowing through the supply duct and around the condenser. As a result, the cool air is warmed, and the vaporized fluid is condensed.

The HVAC system may further comprise a blower located outside of the supply duct. The blower functions to control heat transfer between the evaporator section (the first conducting section) and the warm air outside of the supply duct. Additionally, the blower may be controlled by an automated operating device, such as a thermostat or a humidistat. The evaporator section (located outside the supply duct) may be oriented in a variety of configurations. For example, the evaporator section may be parallel with or perpendicular to the condenser section (the second conducting section), which is located within the supply duct. Therefore, the orientation of the evaporator section may be modified according to variables such as space availability outside the supply duct and the direction of air flow caused by the blower in the outer air passage.

In a further embodiment of the present invention, additional control of the HVAC system is provided by at least one other control device located within the HVAC system supply duct. For example, the control device may comprise a motor-actuated damper mechanism having an automated operating device.

Still further objects of the present invention are accomplished by an HVAC system that utilizes at least one secondary heat transfer unit. The secondary heat transfer unit functions to control the transfer of heat within individual heating or cooling zones of a building having a central HVAC system. The secondary heat transfer unit preferably comprises a heat pipe having at least one evaporator section and at least one condenser section. The heat pipe's evaporator section is disposed in a warm air passage of an individual zone, while the heat pipe's condenser section is disposed in a cool air passage of another individual zone.

The heat pipe can further contain a secondary working fluid. The working fluid within the evaporator thermally communicates with warm air in the warm air passage. As the working fluid absorbs heat from the warm air, the warm air is cooled, and the working fluid is vaporized. The vaporized working fluid then passes through one or more interconnecting vapor lines (in some embodiments) to the heat pipe's condenser section. The vaporized fluid within the condenser thermally communicates with cold air in the cold air passage. As the vaporized fluid releases heat into the cold air, the cold air is warmed, and the vaporized fluid condenses. The condensed fluid then returns to the evaporator section through one or more interconnecting liquid lines (in some embodiments).

In a presently preferred embodiment of the present invention, one or more mechanisms may be provided within the heat pipe to precisely control the amount of heat transferred by the heat pipe. These mechanism(s) may interrupt or modulate the flow of the working fluid between the components of the heat pipe. For example, flow control valves may be installed between the evaporator and the condenser to interrupt or reduce the flow of working fluid from the evaporator to the condenser, or vice versa. Such valves can thereby prevent or reduce heat transfer by the heat pipe from the heat source (hot air) to the heat sink (cold air). The control valves may be manually operated, may be controlled by an automatic operating device such as a thermostat or humidistat, or may be remotely controlled.

In a presently preferred embodiment, flow control valves may be installed between the heat pipe's condenser section and the heat pipe's evaporator section to ensure that the interconnecting liquid line(s) do not allow the working fluid to flow from the evaporator back to the condenser. Similarly, in another embodiment, the interconnecting liquid lines may be geometrically configured so that the condensed working fluid is prevented from flowing back to the condenser from the evaporator. Additionally, the interconnecting liquid lines may be configured to prevent vaporized working fluid from flowing out of the condenser and traveling to the evaporator until the vaporized fluid is condensed. Further, the interconnecting liquid lines may be configured to prevent vaporized working fluid from flowing out of the evaporator to the condenser through the interconnecting liquid lines. The above indicated mechanisms and configurations function to ensure that vaporized fluid flows from the evaporator to the condenser via the interconnecting vapor line(s), and that condensed fluid flows from the condenser to the evaporator via the interconnecting liquid line(s). When such a flow is maintained, the heat transfer process caused by the heat pipe will be continuous, as long as there is a temperature difference between the heat source (warm air surrounding the heat pipe evaporator) and the heat sink (cold air surrounding the heat pipe condenser).

Other objects, features, and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which:

FIG. 1 is a schematic of one embodiment of the present invention incorporated into an air handler and including a flow control mechanism;

FIG. 2 is a schematic of the embodiment shown in FIG. 1 including an alternative flow control mechanism for the working fluid in the heat pipe;

FIG. 3 is a schematic of one embodiment of the present invention configured as a heating apparatus;

FIG. 3A is a schematic that illustrates various alternative embodiments of the present invention;

FIG. 3B is a schematic illustration of the embodiment of FIG. 3A;

FIG. 4 is a schematic of one embodiment of the present invention including a supply duct of a heating system;

FIG. 5 is a schematic of an alternative embodiment of the type of apparatus depicted in FIG. 4; and FIG. 6 is a schematic of one embodiment of the present invention incorporated into supply and return/exhaust ducts or plenums for zones of a centrally located HVAC system.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions and operations. The same numerals are used to designate the same or analogous elements throughout the FIGS. It is contemplated that elements from one exemplary embodiment may be combined with elements of another exemplary embodiment to yield yet other embodiments.

Referring to FIGS. 1–3, the construction and operation of presently preferred embodiments of the invention will now be discussed. Other embodiments are also anticipated and are intended to be part of this invention.

FIGS. 1–3 illustrate a portion of an HVAC (cooling) system generally designated by the numeral 10 and constructed in accordance with the present invention. System 10 comprises an air handler conduit 50. Conduit 50 defines an air inlet 33, an air outlet 34, and an air passage 9 that is generally located between inlet 33 and outlet 34. System 10 further comprises a draw-through blower 40 which has a rotatable fan blade that is schematically indicated by the circle that is designated by the numeral 41. Blower 40 is configured and disposed to draw air through air passage 9, so that warm air enters air passage 9 at inlet 33, and the air (after being cooled and/or dehumidified) exits air passage 9 at outlet 34. Warm air entering inlet 33 and cooler air exiting outlet 34 is schematically represented in FIGS. 1–3 by the arrows designated 11*a* and 11*b*, respectively.

In accordance with the present invention, a primary heat transfer unit, cooling coil 13, is provided. Generally, primary heat transfer units, such as cooling coil 13, comprise a conventional chilled water coil and/or a direct expansion coil. As such, cooling coil 13 may contain a primary working fluid, such as chilled water, Freon, or other refrigerant. The primary working fluid within cooling coil 13 thermally communicates with warm air passing through air passage 9. Accordingly, the primary working fluid absorbs heat from the warm air, and the warm air is cooled and/or dehumidified.

As described above, warm air is cooled as it passes through air passage 9 and around main cooling coil 13. Therefore, the air 11*a* upstream of cooling coil 13 is warmer than air 11*b* that is downstream from cooling coil 13. The temperature difference between the warm upstream air and the cooler downstream air may be utilized to drive a dehumidification heat pipe heat exchanger. For example, the warm upstream air 11*a* may act as a heat source for a heat pipe evaporator, and the cold downstream air 11*b* may act as a heat sink for a heat pipe condenser. Accordingly, as described above in the present specification, heat may be transferred from the warm upstream air 11*a* to the cooler downstream air 11*b* via a working fluid within the heat pipe. A detailed description of the operation and design of one example of a heat pipe suitable for use in the present invention is set forth in Applicant's related application. However, it should be appreciated that other heat pipes and similar mechanisms may also be suitable for use in the present invention.

As shown in FIGS. 1 and 2, a heat pipe of the present invention has an evaporator section 12 and a condenser section 14, both being in thermal communication with air passage 9. Interconnecting lines or loops carry a secondary working fluid from evaporator 12 to condenser 14, and vice versa, so that the secondary fluid can flow continuously throughout the heat pipe. As described above in the present specification, the secondary fluid absorbs heat at evaporator 12 and releases the heat at condenser 14.

As schematically depicted in FIG. 1, one embodiment of the present invention includes at least one interconnecting vapor line 22 that provides a passage for vapor flow from evaporator 12 to condenser 14. Preferably, vapor line 22 is connected to evaporator 12 by one or more vapor outlet lines 21 and to condenser 14 by one or more vapor inlet lines 23. The vapor outlet line(s) 21 of evaporator 12 and the vapor inlet line(s) 23 of condenser 14 are desirably merged with interconnecting vapor line 22 to form a single interconnecting vapor line 22. Arrows designated 15 indicate the flow of secondary fluid in the vapor state from evaporator 12 to condenser 14 through interconnecting vapor line 22. In some applications, interconnecting vapor line 22 may include an adiabatic section to prevent the secondary working fluid from releasing or absorbing heat during its transition from evaporator 12 to condenser 14. Such an adiabatic section may be formed in various configurations to provide finer control over the amount and rate of heat transfer occurring within the heat pipe.

In accordance with the present invention, the embodiments of FIGS. 1 and 2 further include at least one interconnecting liquid line 20 that provides a passage for the secondary fluid in the condensed liquid state to flow from condenser 14 to evaporator 12, as indicated by arrows 16. In some applications, condenser 14 is positioned at an incline above evaporator 12, such that gravity forces the condensed secondary fluid to flow from condenser 14, through interconnecting liquid line(s) 20, to evaporator 12. It should be appreciated, however, that such an incline may not be required in all applications as pressure differentials within the heat pipe may drive the condensed secondary fluid from condenser section 14 to evaporator section 12.

In accordance with the present invention, the interaction of a heat pipe heat exchanger with an air conditioning (cooling) system (as depicted in FIGS. 1 and 2) is described below. However, it should be appreciated that such a heat pipe heat exchanger may also operate in conjunction with a conventional heating or ventilation system.

Referring now to FIGS. 1 and 2, air 11*a* generally comprises (a) warm air from outside, (b) return air from a conditioned zone, or (c) a combination of the two. Hot air 11*a* enters conduit 50 via inlet 33 and thermally communicates with the heat pipe's evaporator section 12. The secondary fluid within evaporator 12 absorbs heat from air 11*a*. As a result, the temperature of air 11*a* becomes lower as air 11*a* becomes precooled. The precooled air then thermally communicates with the primary heat transfer unit, which is main cooling coil 13. The primary working fluid within cooling coil 13 absorbs additional heat from the precooled air. As a result, the precooled air is cooled further and may be dehumidified. It should be appreciated that the process of precooling air 11*a*, via evaporator 12, brings the air closer to its dew point before the air thermally communicates with main cooling coil 13. Consequently, cooling coil 13 has to remove less heat in order to cool and dehumidify air 11*a* to the desired temperature and moisture content level. As a result, cooling coil 13 requires less energy in order to perform its function.

The air leaving cooling coil 13 is ideally at or below saturation. Therefore, this air may require reheating in order to make this air's temperature more comfortable to humans. Furthermore, reheating this air will lower its relative humidity and will reduce this air's likelihood of depositing condensation in the supply air ducts.

As shown in FIGS. 1 and 2, the cooled air flows from cooling coil 13 to the heat pipe's condenser section 14. The cooled air thermally communicates with the heat pipe's condenser section 14, and the cooled air absorbs heat from the working fluid within condenser section 14. As a result, the cooled air is warmed before it leaves conduit 50 via outlet 34.

Unless properly controlled, however, the reheating process may result in a warmer supply air temperature than is desired. For example, at peak load times (i.e., incoming when air 11*a* is very warm), one may want to maximize the sensible heat removing capacity of the cooling system in order to cool air 11*a* to its lowest possible temperature. In such a case, it may be inefficient and counterproductive to reheat the cooled air before it exits the cooling system. Therefore, it may be necessary to reduce the heat pipe's heat transfer rate in order to maximize the system's cooling capacity and deliver the cooled supply air at the lower temperature. By reducing the heat pipe's heat transfer rate, the supply air 11*b* may not be reheated above its dewpoint temperature, and the air 11*b* may be delivered to a conditioned zone at a lower temperature. As a result, the zone's temperature may be more effectively controlled.

Thus, in accordance with the present invention, one or more control devices may be provided to ensure the proper flow of secondary fluid within the heat pipe. The flow of vaporized secondary fluid from evaporator section 12 to condenser section 14 via liquid flow lines 20 is known as "reverse flow" and is to be avoided in order to ensure proper control over the heat transfer process in the system 10. As shown in FIG. 1 for example, a secondary control device, such as control valve 60, may be disposed along each interconnecting liquid line 20. Valve 60 may be provided in the form a check valve or other valve to ensure that secondary fluid does not flow through interconnecting liquid line(s) 20 in the direction leading from evaporator section 12 to condenser section 14. Check valves 60 only permit flow in the direction from condenser section 14 to evaporator section 12.

In another embodiment of the present invention, as shown in FIG. 2, interconnecting liquid line(s) 20 may be configured into a geometrical shape. Such a geometrical configuration ensures that only condensed secondary fluid flows through interconnecting liquid line(s) 20 and that vaporized secondary fluid does not flow through line(s) 20. This configuration also prevents "reverse flow." Additionally, such a configuration may render the use of control valves unnecessary for this purpose. As depicted in FIG. 2, each interconnecting liquid line 20 includes a trap segment 24 and is inclined downward as one moves from condenser section 14 toward trap segment 24 and from evaporator section 12 toward trap segment 24. This inclination utilizes the force of gravity to ensure that only condensed secondary fluid returns to evaporator 12 from condenser 14. Further, trap segment 24 generally remains flooded with condensed secondary fluid. Moreover, as shown in FIGS. 2 and 3, interconnecting liquid line(s) 20 and trap segments 24 may be disposed outside passage 9 and conduit 50.

As shown in FIG. 2 for example, each interconnecting liquid line 20 includes a first inclined segment 27 and a second inclined segment 29, and trap segment 24 is disposed between and communicating with first segment 27 and second segment 29. Each first segment 27 is disposed at a downward incline from evaporator section 12 of the secondary heat transfer component to trap segment 24. Similarly, as shown in FIG. 2 for example, each second segment 29 is disposed at a downward incline from condenser section 14 of the secondary heat transfer component to trap segment 24.

Other control mechanisms may be used to modulate the performance of the secondary heat transfer unit and the HVAC system. As shown in FIGS. 1 and 2, a vapor flow control device 30 may be configured and disposed to modulate the flow of vaporized secondary fluid from evaporator section 12 to condenser section 14. Control device 30 may be provided as an on/off solenoid valve or another type of flow control valve such as an orifice-type control device. A controllable, variable flow control device is suitable for control device 30 and is capable of increasing or decreasing the flow of vaporized fluid from evaporator section 12 to condenser section 14. Ideally, control device 30 may be remotely and precisely operated to regulate the rate of vaporized secondary fluid that flows through interconnecting vapor line 22 from evaporator 12 to condenser 14. For example, Direct Digital Control ("DDC") devices may be used that can be remotely controlled to vary the flow of vaporized secondary fluid between zero percent (0%) to one hundred percent (100%) full flow as desired. Such a device 30 may efficiently control heat transfer between the cooled air and the vaporized secondary fluid within the condenser section 14 by decreasing or increasing the rate of fluid flow within the condenser. For example, when the flow rate of the secondary fluid is decreased, the heat pipe's heat transfer rate will decrease. Preferably, the operation of control valve 30 is performed remotely and automatically as an integral part of the HVAC control system.

FIG. 3 shows another embodiment of an HVAC (heating) system constructed in accordance with the present invention. As shown, system 10 comprises an air handler conduit 50. Conduit 50 defines an air inlet 33, an air outlet 34, and an air passage 9 that is generally located between inlet 33 and outlet 34. System 10 further comprises a draw-through blower 40. Blower 40 is configured and disposed to draw air through air passage 9, so that cool air enters air passage 9 at inlet 33, and the air (after it has been warmed) exits air passage 9 at outlet 34. Cool air entering inlet 33 and warmer air exiting outlet 34 is schematically represented in FIG. 3 by arrows 11*a* and 11*b*, respectively.

In accordance with the present invention, a primary heat transfer unit 13 is provided. Additionally, a secondary heat transfer unit is provided to further regulate the temperature of air flowing through air passage 9. The secondary heat transfer unit preferably comprises at least two heat conducting sections, 14*a* and 14*b*. As illustrated in FIG. 3, the secondary heat transfer unit preferably includes a dehumidification heat pipe heat exchanger as described above regarding the embodiments of FIGS. 1 and 2. In addition, however, the embodiment shown in FIG. 3 further includes another heat exchanger vessel 70. As such, system 10 may function as both an air cooler (as described above regarding the embodiments of FIGS. 1 and 2) and as an air heater. Accordingly, the embodiment of FIG. 3 provides a means of heat transfer during the cooling season and during the heating season (when cooling coil 13 is inoperative).

During the heating season, heat pipe components 14*a* and 14*b* operate in conjunction with vessel 70 to transfer heat from vessel 70 into air passage 9. During such operation, components 14*a* and 14*b* function together as a condenser portion of a heat pipe heat exchanger. Condenser sections 14*a* and 14*b* are preferably provided with interconnecting lines or loops 20, 22, such that a secondary working fluid may flow continuously between them.

One embodiment of the present invention includes at least one interconnecting liquid/vapor line 20. Interconnecting line 20 may act as both an evaporator and as a passage for the secondary fluid to flow within the secondary transfer heat unit.

According to the present invention, heat exchanger vessel 70 is preferably disposed external to the air stream in which first condenser section 14*a* and second condenser section 14*b* are disposed. Further, vessel 70 contains a heated working fluid for effecting a transfer of heat to the secondary heat transfer unit via trap segments 24 of lines 20. More particularly, vessel 70 is configured so that the heated working fluid is in thermal communication with the secondary fluid of the secondary heat transfer unit.

As shown in FIG. 3 for example, each interconnecting liquid line 20 includes a first inclined segment 27 and a second inclined segment 29, and trap segment 24 is disposed between and communicating with first segment 27 and second segment 29. Each first segment 27 is disposed at a downward incline from first condenser section 14*a* of the secondary heat transfer component to trap segment 24. Similarly, as shown in FIG. 3 for example, each second segment 29 is disposed at a downward incline from second condenser section 14*b* of the secondary heat transfer component to trap segment 24.

Heat exchanger vessel 70 may be provided in the form of a shell-and-tube heat exchanger having its heat transfer portions inside or outside of conduit 50. Preferably, as shown in FIG. 3, vessel 70 is disposed outside of conduit 50, so that vessel 70 does not increase the air flow resistance within air passage 9. In a shell-and-tube heat exchanger vessel 70, an external heat source may be introduced on either the shell side or the tube side. In FIG. 3, a heated working fluid provides the external heat source. It should be appreciated that the heated working fluid may be a heated liquid or gas. The heated working fluid is introduced via an inlet conduit 80 that is associated with shell side 71 of vessel 70. The fluid flows through vessel 70 and exits shell side 71 via outlet conduit 90.

In accordance with the present invention, the embodiment of FIG. 3 may function as a heating system as described below. However, it should be appreciated that the embodiment of FIG. 3 may also operate in conjunction with a cooling or ventilation system. As schematically illustrated in FIG. 3, interconnecting vapor/liquid line(s) 20, which include trap segments 24 and inclined segments 27 and 29, form the tubes of vessel/evaporator 70 and permit the heated working fluid (in the shell-side of vessel 70) to thermally communicate with the secondary working fluid. The secondary working fluid flows through the tubes of vessel/evaporator 70 and absorbs heat from the heated working fluid that flows through lines 20, which include trap segments 24 and inclined segments 27 and 29. As a result, the secondary fluid is vaporized and passes from vessel/evaporator 70 to condenser sections 14*a* and 14*b* via interconnecting lines 20 and 22.

Within condenser sections 14*a* and 14*b*, the secondary fluid thermally communicates with cool air 11*a* that is flowing through air passage 9. Air 11*a* generally comprises (a) cool air from outdoors, (b) return air from a zone being served, or (c) a combination of the two. Therefore, cool air 11*a* absorbs heat from the secondary fluid that is within condenser sections 14*a* and 14*b*. As a result, cool air 11*a* is warmed, and the secondary fluid is condensed and returns via gravity and/or pressure differentials to vessel 70 through interconnecting line(s) 20. The secondary fluid is then reheated, and the continuous heat pipe heat transfer process continues.

It should be appreciated that the application of vessel 70 to the secondary heat transfer unit will provide an efficient and effective method of heating air within air passage 9. Thus, such an application eliminates the need for or reduces the size of other commonly used winter heating techniques and equipment, such as preheat and winter heat coils. Further, such an application may reduce the amount of energy spent during the cooling season. For example, the application of vessel 70 to the secondary heat transfer unit, as described above, may help reduce air flow resistance within air passage 9. As a result, blower 40 will use less energy to provide an appropriate air flow rate through air passage 9. Accordingly, the HVAC system will be more energy efficient.

In accordance with the present invention, control mechanisms may be used to further enhance the performance of the secondary heat transfer unit and the overall HVAC system. Referring again to FIG. 3, one means for controlling the flow of secondary fluid between condensers 14*a* and 14*b* is provided. As in FIG. 2, the interconnecting line(s) 20 of FIG. 3 may be configured into a particular geometrical shape to control secondary fluid flow through line(s) 20. FIG. 3 shows interconnecting line(s) 20 being inclined downward with respect to condenser sections 14*a* and 14*b*, such that gravity ensures that heat pipe evaporator 70 remains flooded with condensed secondary fluid. When vaporized fluid condenses within condensers 14*a* and 14*b*, the condensed liquid flows down to evaporator 70.

As shown in FIG. 3, a control valve 100 may be configured and disposed to control the flow of heated working fluid through shell 71 of vessel 70. Control valve 100 may be provided in the form of a solenoid valve to regulate the flow of heated working fluid from conduit 80 to conduit 90. As such, valve 100 may permit efficient control of the amount of heat transferred by the heated working fluid to the secondary fluid within the secondary heat transfer unit. Preferably, valve 100 can be provided in the form of a valve that is continuously variable between being completely closed and completely open. The operation of control valve 100 is desirably performed remotely and automatically as an integral part of the HVAC control system. DDC technology also can be employed.

The embodiments of the present invention can be implemented with heat pipes that are configured and disposed to extend generally horizontally or generally vertically, as desired. In the schematic diagrams of FIGS. 1–3, the rectangular shapes designated 31 and 39 are intended to represent vertically extending support members that carry sections of heat pipes that extend horizontally. The circles designated 49 and 69 in FIGS. 1–3 are intended to represent horizontally extending heat pipe sections that extend into and out of the paper in those views. As shown in FIGS. 1–3, the vapor outlet lines 21, vapor inlet lines 23 and interconnecting liquid lines 20 are disposed to approach the support members from the opposite sides. In alternative embodiments shown in FIG. 3A for example, heat pipe sections 39, 69 that extend generally vertically are employed in place of generally horizontally extending heat pipe sections 39, 69 shown in FIGS. 1–3, for example. In the FIG. 3A embodiments, the support members 31 and 39 could extend generally horizontally, and the vapor outlet lines 21, vapor inlet lines 23 and interconnecting liquid lines 20 are disposed to approach the horizontally extending support members from above and below via headers.

In the FIG. 3A embodiment, an air handler has the capability of operating more efficiently in both summer and winter. During summer cooling, the air handler of FIG. 3A has the capability of controlling dehumidification via a heat exchanger 70*a* associated with vapor line 22. When the FIG. 3A embodiment is in the cooling and dehumidification mode, section 14*a* becomes an evaporator section, and valve 101 is opened to permit flow through heat exchanger 70*a* while valve 100 is closed to render heat exchanger 70 inoperative. Additionally, the FIG. 3A embodiment also has the capability of external supplemental heating during use as a heating system via heat exchanger 70 associated with liquid line 20. When the FIG. 3A embodiment is in the heating mode, section 14*a* becomes a condenser section, and valve 100 is opened to permit flow through heat exchanger 70 while valve 101 is closed to render heat exchanger 70*a* inoperative.

Shown in FIG. 3B is an air conditioning system for utilizing heat pipes to maximize the efficiency of air cooling comprising a chiller. The chiller has an input end adapted to receive input air to be cooled and an output end adapted to discharge cooled air for movement into a chamber with an associated fan to cause the flow of air through the chiller. The chiller further has a fluid to cause cooling of the chiller.

A plurality of heat pipes include an upper heat pipe and a lower heat pipe. Each of the heat pipes includes an input coil in a serpentine configuration at the input end of the chiller for the passage of input air there through. Each of the heat pipes further includes an output coil in a serpentine configuration at the output end of the chiller for the passage of output air there through. Further included is an upper horizontal vapor leg coupling associated input coils and output coils for the passage of vapor and a lower horizontal liquid leg 20 coupling associated input coils and output coils for the passage of liquid. The input and out-put coils and the vapor and liquid legs function to cause the flow of a working fluid there through in a continuing cycle of operation.

An upper back flow abater is formed as an upper one way check valve 30 for the vapor leg for controlling the back flow of the working fluid within the vapor leg.

An upper shell and tube heat exchanger 70 encompasses the vapor line in advance of the upper one way check valve. It includes an inlet line 80 and an outlet line 90 to direct the flow of fluid associated with the chiller to cool the working fluid in the vapor line.

A lower back flow abater 30A forms a lower one way check valve for the liquid leg 20 for controlling the back flow of the working fluid within the liquid leg.

A lower shell and tube heat exchanger 70A encompasses the liquid line in advance of the lower one way check valve. It includes an inlet line 80A and an outlet line 90A to direct the flow of fluid to heat the fluid in the liquid line.

A supplemental back flow abater is formed by upwardly extending lines as part of the liquid line on opposite sides of the lower heat exchanger functions as a U-shaped trap.

Referring now to FIGS. 4 and 5, a further embodiment of the present invention is schematically illustrated. Supply duct 115 of an HVAC system comprises a conduit 50 that defines a supply duct inlet 103, a supply duct outlet 104, and a supply duct passage 109 that is generally located between inlet 103 and outlet 104. Air entering inlet 103 and exiting outlet 104 is schematically represented in FIGS. 4 and 5 by arrows designated 11*a* and 11*b*, respectively.

An outer air passage 19 is located outside of conduit 50 and between an outer air inlet 25 and an outer air outlet 18. Air entering inlet 25 and exiting outlet 18 is schematically represented in FIGS. 4 and 5 by arrows 17*a* and 17*b*, respectively.

In accordance with the present invention, a secondary heat transfer unit is provided for regulating the temperature of air flowing through supply duct 115. A secondary heat transfer unit 91 generally has at least one heat transfer component that is disposed within supply duct 115 and in thermal communication with the air flowing through supply duct 115. As shown in FIGS. 4 and 5, a condenser section 14 provides the heat transfer component that is disposed within supply duct 115 and in thermal communication with the air flowing through supply duct 115.

Moreover, secondary heat transfer unit 91 has at least one heat transfer component that is disposed outside supply duct 115 and in thermal communication with the air flowing outside supply duct 115. As shown in FIGS. 4 and 5, an evaporator section 12 provides the heat transfer component that is disposed outside supply duct 115 and in thermal communication with the air flowing outside supply duct 115.

Generally, the heat transfer components of secondary heat transfer unit 91 disposed inside and outside of supply 115 comprise the heat conducting sections of at least one heat pipe. As shown in FIGS. 4 and 5, secondary heat transfer unit 91 of the present invention preferably includes a plurality of individual heat pipes 28. Each such heat pipe 28 generally includes at least two heat conducting sections connected by an interconnecting loop or a combination of vapor and liquid lines. A secondary fluid flows through the heat conducting sections as the working fluid. In one embodiment, the interconnecting loop may be provided by a common interconnecting line, in which flows condensed secondary fluid (i.e., secondary fluid in its liquid state) in one direction and vaporized secondary fluid in the opposite direction.

The secondary fluid within a heat pipe 28 thermally communicates with cold air 11*a* within supply duct 115 via condenser 14. Similarly, the secondary fluid thermally communicates with warm air 17*a* outside supply duct 115 via evaporator 12.

In one embodiment, as shown in FIG. 4, condenser section 14 of heat pipe 28 is substantially aligned parallel with evaporator section 12. In another embodiment, as shown in FIG. 5, however, the conducting sections of secondary heat transfer unit 91 may be configured into an approximate L-shape to provide a more compact system. A further description of the operation and design of one example of a heat pipe suitable for use in the present invention is set forth in more detail in Applicant's related application. However, it should be appreciated that other heat pipes and similar mechanisms are also suitable for use as the secondary heat transfer unit in the present invention.

In accordance with the present invention, the embodiments of FIGS. 4 and 5 may function as a heating system as described below. However, it should be appreciated that the embodiments of FIGS. 4 and 5 may also operate in conjunction with an air conditioning or ventilation system.

As schematically shown in FIGS. 4 and 5, warm air 17*a*, generally from a conditioned zone (within the building), flows through outer passage 19. Evaporator 12 thermally communicates with warm air 17*a*, and the secondary working fluid within evaporator 12 absorbs heat. As a result, the secondary fluid vaporizes and then passes to condenser section 14. Within supply duct 115, condenser section 14 thermally communicates with cool air 11*a*, which generally comes from an air handler that is supplying the space being served. Cool air 11*a* absorbs heat from the vaporized secondary fluid within condenser 14. As a result, cool air 11*a* is warmed and the secondary fluid is condensed to its liquid state.

In some embodiments, warm air 17*a* comprises return air from the room being served by supply duct 115. In such embodiments, cool air 11*a* recovers heat from air leaving the room that the air 11*a* is serving. In other embodiments, warm air 17*a* may comprise air within the room being served by supply duct 115. As described above, after cool air 11*a* has been cooled and dehumidified by a primary cooling device, the cool air 11*a* may require reheating to bring the cool air to a more comfortable temperature. When reheating systems are not used or unavailable, the flow of cool air 11*a* from supply duct 115 has been decreased, so that the flow of cold air into a zone is not uncomfortable. Unfortunately, when cold air flow rates are reduced in order to make the cool supply air 11*a* more comfortable, other disadvantages may occur. For example, decreasing air flow rates into a zone may inappropriately decrease air turnover rates within that zone. As a result, the fresh air supply to the zone may be insufficient to ensure the comfort of the zone's inhabitants. Consequently, it may be preferable to reheat the overcooled air rather than reduce the cold air flow rate.

The heat transfer system of the present invention may be used to reheat cool supply air in lieu of electrical strip heat, hot water heating sources, or other external energy sources that are currently being used by central HVAC systems. By recovering heat from warm return air (or from warm air within the zone being served), the present invention saves external energy. Furthermore, in certain applications, the present invention imposes less air resistance within passage 109 than alternative heating systems. Therefore, as discussed above, energy efficiency of the HVAC system will be improved. Furthermore, because air flow is not compromised when the present invention is used, the present invention is more compliant with indoor air quality concerns.

In accordance with the present invention, control mechanisms may be used to further enhance the performance of the secondary heat transfer unit and the HVAC system. As shown in FIG. 4, a blower or fan 26 may be provided to control the flow of air 17*a* through outer air passage 19. Accordingly, fan 26 may control the amount of heat transferred to evaporator 12 and the secondary fluid. Therefore, fan 26 may control the amount of heat transferred via condenser 14 to cool air 11*a* within supply duct 115. A control device 160, such as a humidistat or thermostat, may be provided to electrically control fan 26. Control device 160 may be electrically connected to fan 26 via wiring 85.

As shown in FIG. 5, further control mechanisms may be provided to control the heat transfer process within supply duct 115. For example, a damper 95 may be disposed within supply duct passage 109 to provide additional heat transfer control. When damper 95 is operated so as to restrict air flow, less air flow is allowed through supply duct 115. As a result, less heat transfer will occur between cool air 11*a* and condenser 14. A motor 96 may be configured and disposed to actuate damper 95. Such a motor may be operated by a control device 86, which may be electrically connected via wiring 85. Examples of suitable control devices 86 include a humidistat and a thermostat. Preferably, the operation of control device 86 and control device 160 can be performed remotely and automatically as an integral part of the HVAC control system. DDC technology also can be employed.

Referring to FIG. 6, still another embodiment of the present invention is shown. Accordingly, a secondary heat transfer unit is provided. Such a secondary heat transfer unit allows controlled heat transfer between a supply duct and an exhaust/return ventilation duct within a structure having a centralized HVAC system. One such embodiment preferably includes a heat pipe. The heat pipe has at least a first heat transfer component in thermal communication with a warm air stream, and at least a second heat transfer component in thermal communication with a cool air stream. In a preferred embodiment, the first heat transfer component is an evaporator 12, and the second heat transfer component is a condenser 14. A further description of the operation and design of one example of a heat pipe suitable for use in the present invention is set forth in more detail in Applicant's related application. However, it should be appreciated that other heat pipes and similar heat transfer mechanisms are also available for use in the present invention.

As shown in FIG. 6, one embodiment of a secondary heat transfer unit 107 contains a heat pipe that has an evaporator section 12 and a condenser section 14. A secondary fluid is contained within secondary heat transfer unit 107. Unit 107 is in thermal communication with warm and cool air flowing from at least two ventilation air ducts of a building. Warm air 17 from one air duct thermally communicates with the secondary fluid contained within evaporator 12. Similarly, cool air 11 from a different air duct thermally communicates with the secondary fluid contained within condenser 14.

Interconnecting lines or loops carry a secondary working fluid from evaporator 12 to condenser 14, and vice versa, so that the secondary fluid can flow continuously throughout the system. As described above, the secondary working fluid absorbs heat at evaporator 12 and releases the heat at condenser 14. As schematically depicted in FIG. 6, one embodiment of the present invention includes at least one interconnecting vapor line 22 that provides a passage for vaporized secondary working fluid to flow from evaporator 12 to condenser 14. Preferably, the vapor outlet line(s) 21 of evaporator 12 and the vapor inlet line(s) 23 of condenser 14 are merged with interconnecting vapor line 22 to form a single interconnecting vapor line 22. Arrows 15 indicate the flow of vapor from evaporator 12 to condenser 14 through interconnecting vapor line 22. In some applications, interconnecting vapor line 22 may include an adiabatic section to prevent the secondary working fluid from releasing or absorbing heat during its transit from evaporator 12 to condenser 14. Such an adiabatic section may be formed in various configurations to provide finer control over the amount and rate of heat transfer occurring within the heat pipe.

In accordance with the present invention, the embodiment of FIG. 6 may further include at least one interconnecting liquid line 20 that provides a passage for the secondary fluid in the condensed liquid state to flow from condenser 14 to evaporator 12, as indicated by arrows 16. In some applications, condenser 14 is positioned at an incline above evaporator 12, such that gravity forces the condensed secondary fluid to flow from condenser 14, through interconnecting liquid line(s) 20, to evaporator 12. It should be appreciated, however, that such an incline may not be required in all applications, as a pressure differential may drive the movement of the condensed secondary working fluid.

In accordance with the present invention, the interaction of a heat pipe apparatus (as embodied in FIG. 6) with individual ventilation air ducts is described below. However, it should be appreciated that the embodiment of FIG. 6 may also operate in conjunction with other heating, ventilation, and/or air conditioning systems.

As shown in FIG. 6, warm air 17 from a building zone may be placed in thermal communication with the secondary working fluid of evaporator 12. As warm air 17 thermally communicates with evaporator 12, the secondary working fluid within evaporator 12 absorbs heat from warm air 17. As a result, warm air 17 is cooled, and the secondary working fluid within evaporator 12 is vaporized.

The vaporized secondary working fluid then passes through interconnecting vapor line(s) 22 and into condenser 14. Within condenser 14, the vaporized secondary working fluid thermally communicates with cold air 11 from a different ventilation air duct. Accordingly, cold air 11 absorbs heat from the vaporized secondary working fluid within the condenser. As a result, cold air 11 is warmed, and the vaporized secondary working fluid is condensed.

As described above, a secondary heat transfer unit may be configured to simultaneously cool and heat two air streams from different individual ventilation air ducts of a building having a centralized HVAC system. These cooling and heating processes allow the primary heat transfer unit to be more efficient by enabling it to expend less energy in heating and cooling the building. Additionally the secondary heat transfer unit eliminates the need to use additional external energy to achieve similar results.

In accordance with the present invention, control mechanisms may be used to further enhance the performance of the secondary heat transfer unit and the HVAC system. In general a control device 30 may be configured and disposed to modulate the flow of vaporized secondary working fluid from evaporator 12 to condenser 14. Control device 30 may be provided as an on/off solenoid valve or other valve such as a variable flow valve. Ideally, control device 30 may be remotely and precisely operated to regulate the amount of vaporized secondary working fluid that flows through interconnecting vapor line 22 from evaporator 12 to condenser 14. For example, Direct Digital Control ("DDC") devices may be used that can be remotely controlled to vary the flow of vaporized secondary fluid between 0% to 100% full flow as desired. Such a device 30 may efficiently control heat transfer between the cooled air and the vaporized secondary working fluid within the condenser by decreasing or increasing the rate of fluid flow within the condenser. For example, when the fluid flow is decreased, the heat pipe's heat transfer rate will decrease. Preferably, the operation of control valve 30 is performed remotely and automatically as an integral part of the HVAC control system.

Additionally, one or more control devices may be provided to ensure the proper flow of secondary fluid within the heat pipe. As shown in FIG. 6 for example, a secondary flow control device, such as control valve 60, may be disposed along each interconnecting liquid line 20. Valve 60 may be provided in the form of a check valve or another type of valve to ensure that vaporized secondary fluid and/or condensed secondary fluid does not flow through interconnecting liquid line(s) 20 in the direction from evaporator 12 to condenser 14.

As demonstrated above, the present invention discloses a controllable, multipurpose heat pipe system. Such a system provides an improved, more energy efficient HVAC system. Additionally, the present invention provides a controllable HVAC system that is functional and energy efficient in both cooling and heating seasons. Further, the present invention provides an improved heat transfer system that can help efficiently control the temperature and humidity of air supplied to different zones within a building that utilizes a centralized HVAC system.

It should be appreciated that modifications and variations of the present invention may be practiced by those of ordinary skill in the art without departing from the spirit and scope of the present invention, which is more particularly set forth in the appended claims. In addition, it should be understood that aspects of various embodiments of the present invention may be interchanged both in whole or in part. Furthermore, those of ordinary skill in the art will appreciate that the foregoing description is by way of example only, and is not intended to be limiting of the invention so further described in such appended claims.

What is claimed is:

1. An air conditioning system for utilizing heat pipes to maximize the efficiency of air cooling, comprising, in combination:

a chiller with an input end adapted to receive input air to be cooled and an output end adapted to discharge cooled air for movement into a chamber with an associated fan to cause the flow of air through the chiller, in the chiller having a first working fluid to cause cooling of the chiller;

a plurality of heat pipes including an upper heat pipe and a lower heat pipe, each of the heat pipes including an input coil in a serpentine configuration at the input end of the chiller for the passage or input air there through and an output coil in a serpentine configuration at the output end of the chiller for the passage or output air there through, and upper horizontal vapor leg coupling associated input coils and output coils for the passage of vapor and a lower horizontal liquid leg coupling associated input coils and out coils for the passage of liquid, the input and output coils and the vapor and liquid legs functioning to cause the flow of a second working fluid there through in a continuous cycle of operation;

an upper back flow abater formed as an upper one way check valve for the vapor leg for controlling the back flow of the second working fluid within the vapor leg;

an upper shell and tube heat exchanger encompassing the vapor line in advance of the upper one way check valve and with an inlet line and an outlet line to direct the flow of the first working fluid associated with the chiller to cool the second working fluid in the vapor line;

a lower back flow abater formed as a lower one way check valve for the liquid leg for controlling the back flow of the second working fluid with the liquid leg;

a lower shell and tube heat exchanger encompassing the liquid line in advance of the lower one way check valve and with an inlet line and an outlet line to direct the flow of the first working fluid associated with the chiller to heat the fluid in the liquid line; and a supplemental back flow abater formed by upwardly extending lines as part of the liquid line on opposite sides of the lower heat exchanger to function as a U-shaped trap.

* * * * *